US005628224A

United States Patent [19]

McClung et al.

[11] Patent Number: 5,628,224

[45] Date of Patent: May 13, 1997

[54] METHOD FOR SEQUENTIALLY FORMING CAN BODIES

[75] Inventors: James A. McClung, North Canton; Paul L. Ripple, Canton, both of Ohio

[73] Assignee: Can Industry Products, Inc., Canton, Ohio

[21] Appl. No.: 435,204

[22] Filed: May 5, 1995

[51] Int. Cl.[6] ..... B21D 28/02

[52] U.S. Cl. ..... 72/336; 72/351; 72/404

[58] Field of Search ..... 72/336, 329, 347–351, 72/404, 405.01, 405.06

[56] References Cited

U.S. PATENT DOCUMENTS

| | | | |
|---|---|---|---|
| 768,876 | 8/1904 | Campbell . | |
| 1,424,671 | 8/1922 | Ogden et al. . | |
| 1,431,175 | 10/1922 | Ogden et al. . | |
| 3,115,678 | 12/1963 | Keen | 72/350 |
| 3,194,047 | 7/1965 | Eggert | 72/349 |
| 3,251,319 | 5/1966 | Kaupert | 72/349 |
| 3,557,600 | 1/1971 | Saito | 72/404 |
| 3,695,088 | 10/1972 | Alvi | 72/402.12 |
| 3,762,206 | 10/1973 | Wright et al. | 72/382 |
| 3,902,347 | 9/1975 | Ridgway et al. | 72/336 |
| 4,363,232 | 12/1982 | Reitter | 72/350 |
| 4,550,588 | 11/1985 | Abe | 72/404 |
| 4,567,746 | 2/1986 | Bachmann et al. | 72/348 |
| 4,863,333 | 9/1989 | Kaminski | 413/69 |
| 4,996,864 | 3/1991 | Enami | 72/347 |
| 5,069,057 | 12/1991 | Lee | 72/452.5 |
| 5,359,875 | 11/1994 | Sova | 72/336 |
| 5,442,947 | 8/1995 | Stodd | 72/336 |

*Primary Examiner*—Daniel C. Crane
*Attorney, Agent, or Firm*—Sand & Sebolt

[57] ABSTRACT

Apparatus and method for forming cup-shaped metal container bodies or end shells from a metal blank in a double-acting press having inner and outer rams which operate in a timed relationship. A plurality of blank and draw dies are mounted on a fixed base in opposed relationship to a plurality of draw horns mounted on the inner ram and movable toward the base. A corresponding member of cutting dies and draw pads are mounted on the outer ram and are movable toward the base, whereby the cutting dies cut blank disks from the sheet and the draw pads clamp the disks against the blank and draw dies, followed by the drawing of the container bodies or end shells by the draw horns. The vertical height of the blank and draw dies above the fixed base vary so that the cutting dies sequentially cut the plurality of disks, followed by the sequential clamping of the disks by the draw pads, followed by the sequential drawing of the container bodies by the draw horns to reduce the total force exerted on the press by the sequential staggering of the cutting, clamping, and drawing in single continuous strokes of the inner and outer rams.

4 Claims, 7 Drawing Sheets

METHOD FOR SEQUENTIALLY FORMING CAN BODIES

BACKGROUND OF THE INVENTION

1. Technical Field

The invention relates to forming container bodies from a blank of metal, and, in particular, to forming such bodies in a double-acting press which reduces the forces exerted on the press by sequentially performing the various operations on the blank of metal when forming the container body.

2. Background Information

It is well known in the container-forming art to form two-piece containers, that is, containers in which the walls and bottom of the container are a one-piece member, and the top or end closure is a separate piece, by means of stamping blanks from a strip of metal sheet, and then subsequently drawing the desired configuration into the drawn blank.

In broad terms, the prior art discloses, starting with flat material either in sheet or coil form, blanking material from the sheet stock, and then drawing it into a cup for further redrawing into a final container in the same press or in subsequent operations. There are a considerable number of prior art patents illustrating various approaches to this formation using either single or double-acting presses. Generally, these prior art presses will simultaneously form a plurality of the container bodies in a single stroke of the single or double-acting press. For example, eight, ten, twelve or more container bodies are formed simultaneously by the single stroke of the press, whether it be a single-action or double-action press.

However, one problem that is encountered with these presses is that they produce excessive noise and forces on the press due to the simultaneous engagement of the initial blank sheet with the plurality of cutting dies or cut edges, followed by the simultaneous pressure holding engagement of the peripheral edges of the blanks, followed by the simultaneous drawing of all of the cups or container bodies by the movement of a plurality of inner punch members by the inner ram of a double-acting press. These forces present maintenance problems on the dies and press, as well as limiting the number of container bodies or end shells which can be produced in a single stroke, or require a larger press having higher tonnages.

It is always desirable to produce an apparatus or forming dies and associated method which is capable of producing a plurality of container bodies from steel or aluminum or other stock materials, with a low tonnage press as possible, and with reduced noise and vibrations, while providing the maximum output from the press. However, as indicated above, the forces exerted on the press and dies during the initial blanking, pressure holding and subsequent drawing, limit the output of the press.

Therefore, the need exists for an improved method and apparatus for providing maximum output from a press with as low tonnage rating as possible, while reducing noise and working forces on the apparatus and press.

SUMMARY OF THE INVENTION

Objectives of the invention include providing an improved apparatus and method for forming container bodies in a double-acting press from sheet metal material, wherein the material is blanked and drawn into a cylindrical cup-shaped configuration in a single stroke of a double-acting press, with reduced forces and noise than heretofore believe possible with existing presses.

Another objective of the invention is to provide such a method and apparatus which sequentially blanks, holds and then draws the container body, thereby spreading the forces and resulting noise created on and by the press, over a small period of time by staggering the height of the blank and draw dies on which the sheet metal is cut, held and then drawn into the cup shape.

Still another objective of the invention is to provide such a method and apparatus in which a plurality of container bodies are formed sequentially in the press and die, and in which the sequence of forming the containers from the sheet blank is staggered in a spaced relationship across the sheet to maintain a balanced pressure thereon.

A further objective of the invention is to provide such a method and apparatus which requires relatively minor adjustments to existing press and die constructions and operation, thereby avoiding costly modifications to existing apparatus and technology.

These objectives and advantages are obtained by the improved method of the invention for forming a plurality of container bodies, the general nature of which may be stated as including the steps of feeding metal sheet between a plurality of lower blank and draw dies and a plurality of vertically aligned upper draw horns, draw pads and cut edges; simultaneously advancing at least first and second cut edges and draw pads toward the metal sheet and the blank and draw dies by movement of the outer ram; sequentially blanking a first and then a second disk from the metal sheet by advancing the cut edges in a continuous stroke of the outer ram beyond the blank and draw dies; sequentially clamping peripheries of the disks against the blank and draw dies upon advancement of the draw pads by the continuous stroke of the outer ram; simultaneously advancing at least first and second draw horns toward the first and second disks by movement of the inner ram; and sequentially drawing a first and then a second cup-shaped member from the first and second disks, respectively, by the advancement of the draw horns in a continuous single stroke of the inner ram into engagement with the blank and draw dies.

These objectives and advantages are further obtained by the apparatus of the invention which includes at least first and second draw horns carried by an inner ram and at least first and second blank and draw dies carried by a base in opposed relationship to the first and second draw horns, respectively; at least first and second cutting dies carried by the outer ram and surrounding each of the first and second draw horns, respectively, for sequentially cutting first and second disks from the sheet; at least first and second pressure means carried by the outer ram and surrounding each of the first and second draw horns, respectively, for sequentially holding peripheries of the first and second disks against the first and second blank and draw dies, respectively; means for elevating the first blank and draw die a predetermined distance above the second blank and draw die on the base, whereby the continuous movement of the outer ram toward the base causes the first and second cutting dies to sequentially cut the first disk and then the second disk from the sheet, closely followed by the first and second pressure means holding the peripheries of the disks, followed by the sequential drawing of the first and second cup-shaped members during the continuous downward movement of the inner ram.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

The method and apparatus of the present invention are utilized in conjunction with a double-acting press having an inner ram 10 and an outer ram 12 movable toward and away from a fixed base 14. The complete press will not be described in detail, since such presses are well known in the art, and are exemplified generally in U.S. Pat. No. 3,902,348. These presses have the capability of independently controlling the movement of their rams and the tooling associated therewith.

Figure 1:
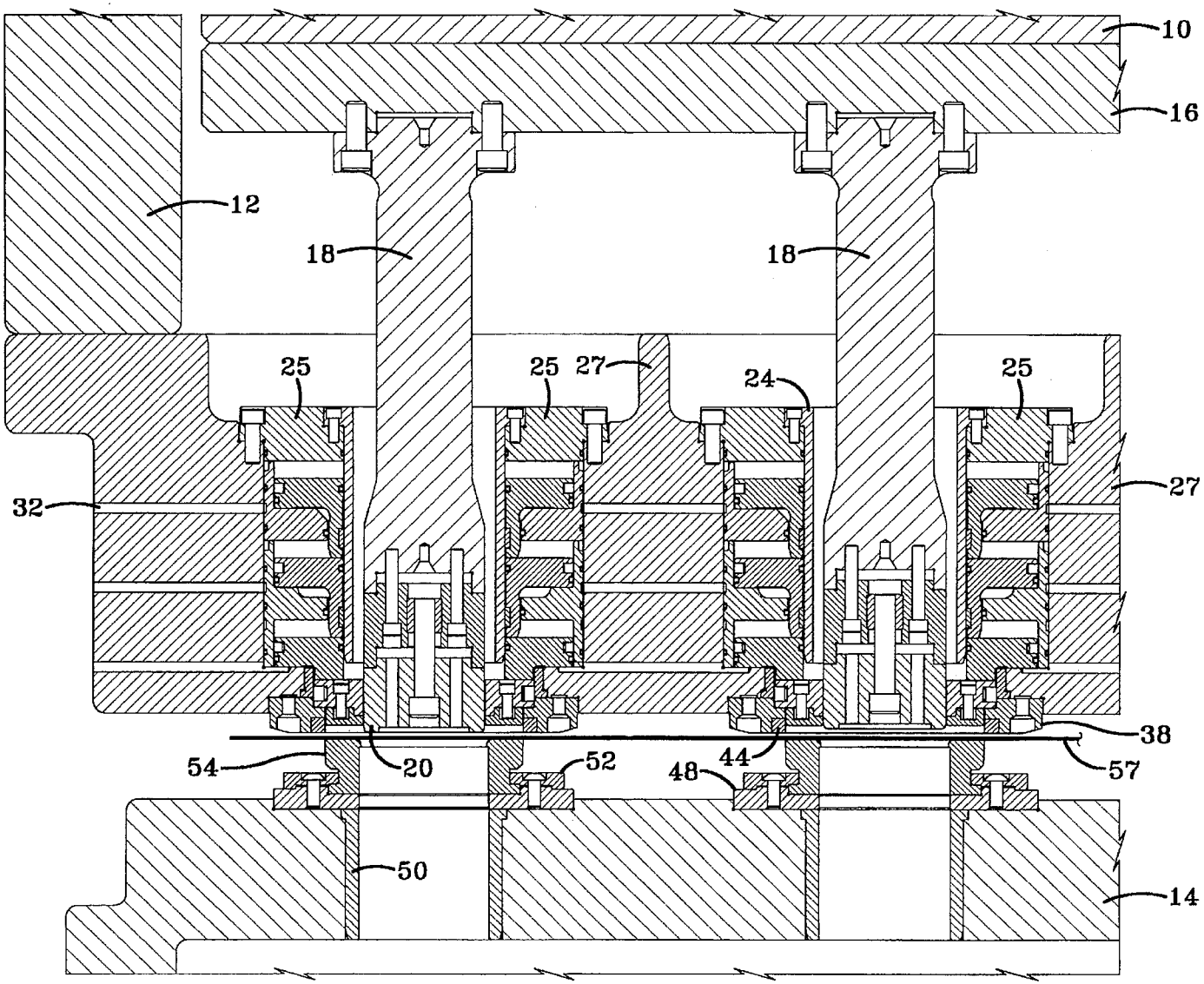
FIG. 1 is a partially schematic sectional view of a portion of the apparatus of the present invention for forming two container bodies in a double-acting press prior to the start of the forming operation.

Referring to FIGS. 1–4 of the drawings, it is noted that inner ram 10 engages an inner punch holder 16 to which is connected a plurality of inner punch risers 18, two of which are shown in FIG. 1. It is understood, and is discussed further below, that a plurality of inner punch risers 18 will be connected to punch holder 16 for simultaneous movement therewith.

FIG. 1 shows two die assemblies of the present invention operatively connected to inner ram 10 and outer ram 12. In the particular press of the present invention, twelve similar assemblies will be spaced in a staggered relationship along the length of the press, only one of which is described in detail and shown particularly in FIGS. 2–4. The various components are exemplary, and are found in most presses and associated dies, and are, therefore, referred to generally, and are well known to anyone skilled in the art. A draw horn 20 is mounted by a horn spacer 21 to inner punch riser 18 by a plurality of bolts 22. Inner punch riser 18 thus will move draw horn 20 in a reciprocal vertical direction upon movement of inner ram 10.

A cylindrical punch sleeve 24 is connected to an end cap 25 by bolts 26, and to outer ram housing 27 by bolts 28. A plurality of annular pistons 30 are fluidly movable within a cylinder 31, which is mounted within ram housing 27. If desired, fluid cylinders could be replaced by springs. A plurality of air vents 32 are formed in outer ram housing 27 to permit air to escape from and enter into the interior of cylinder 31 during the operation of pistons 30. An annular draw pad 34 is secured by bolts 35 to an annular mounting ring 36 which is engaged with lowermost piston **30*a*. An annular retainer ring 38 is mounted by bolts 39 to the lower end of outer ram housing 27 and clamps an annular wear sleeve 39 between housing 27 and draw pad mounting ring 36. An annular cut edge 44 is mounted in a recess formed in retainer ring 38 and is slidably engaged with draw pad 34**.

The various components discussed above are all standard in the art, and their features and functions are well known to those skilled in the art, and, thus, their exact constructions and manner of operation are not described in further detail.

Base 14, which is indicated as being a fixed base, could be fluidly supported, if desired, in order to absorb the forces exerted thereon, without affecting the concept of the invention. A blank and draw retainer ring 48 is mounted within an annular recess 49 formed in base 14, and secures a cup drop sleeve 50 within a cylindrical opening 53 formed in base 14. An annular draw die clamp 52 secures an annular blank and draw die 54 into an annular recess 51 formed in retainer ring 48 by a plurality of bolts 55. Again, the various components described above with respect to base 14 are also well known in the art, and, therefore, their function and exact construction are not described in further detail.

Figure 2:
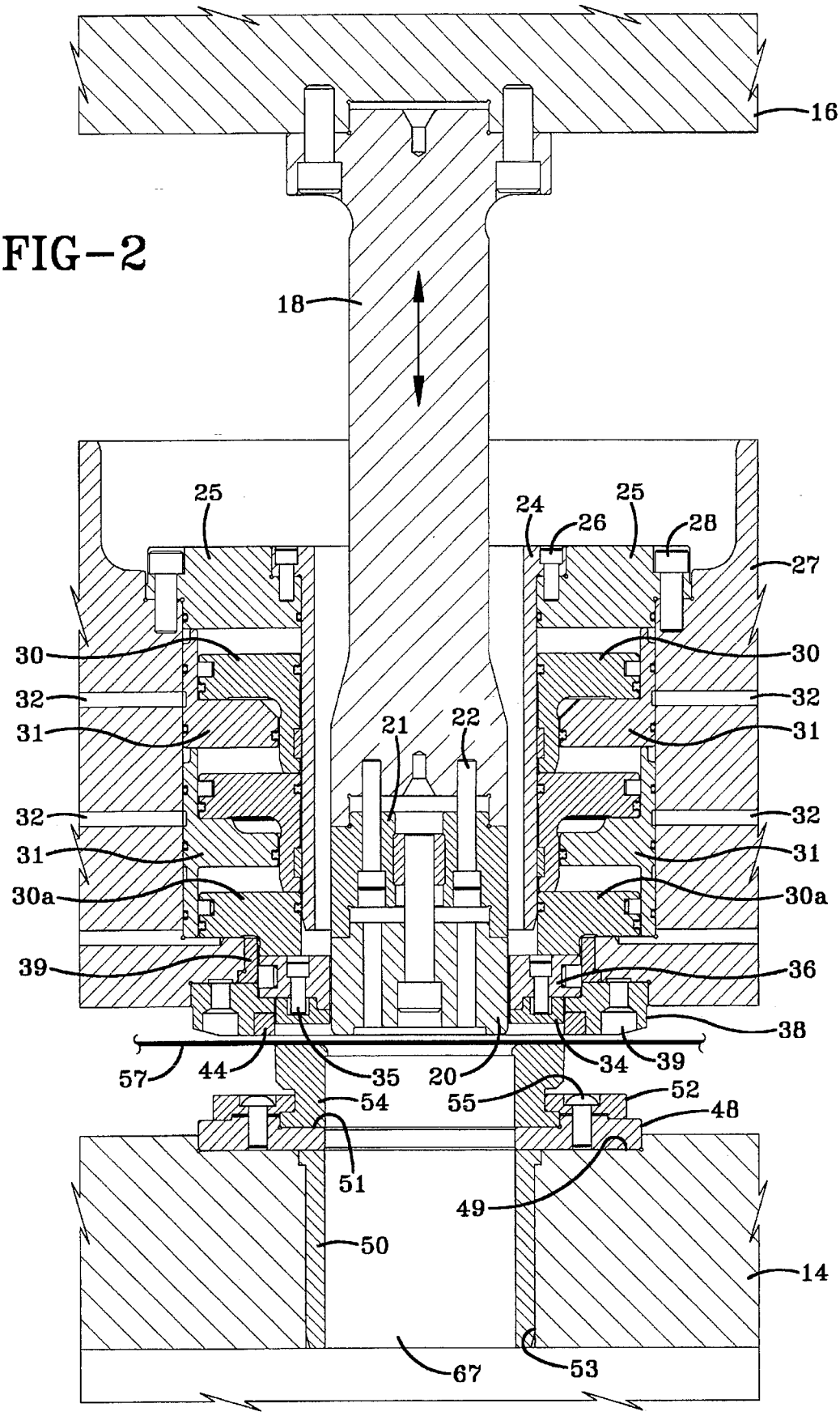
FIG. 2 is an enlarged sectional view of one of the assemblies of the apparatus of FIG. 1 for carrying out the method of the invention.
Figure 3:
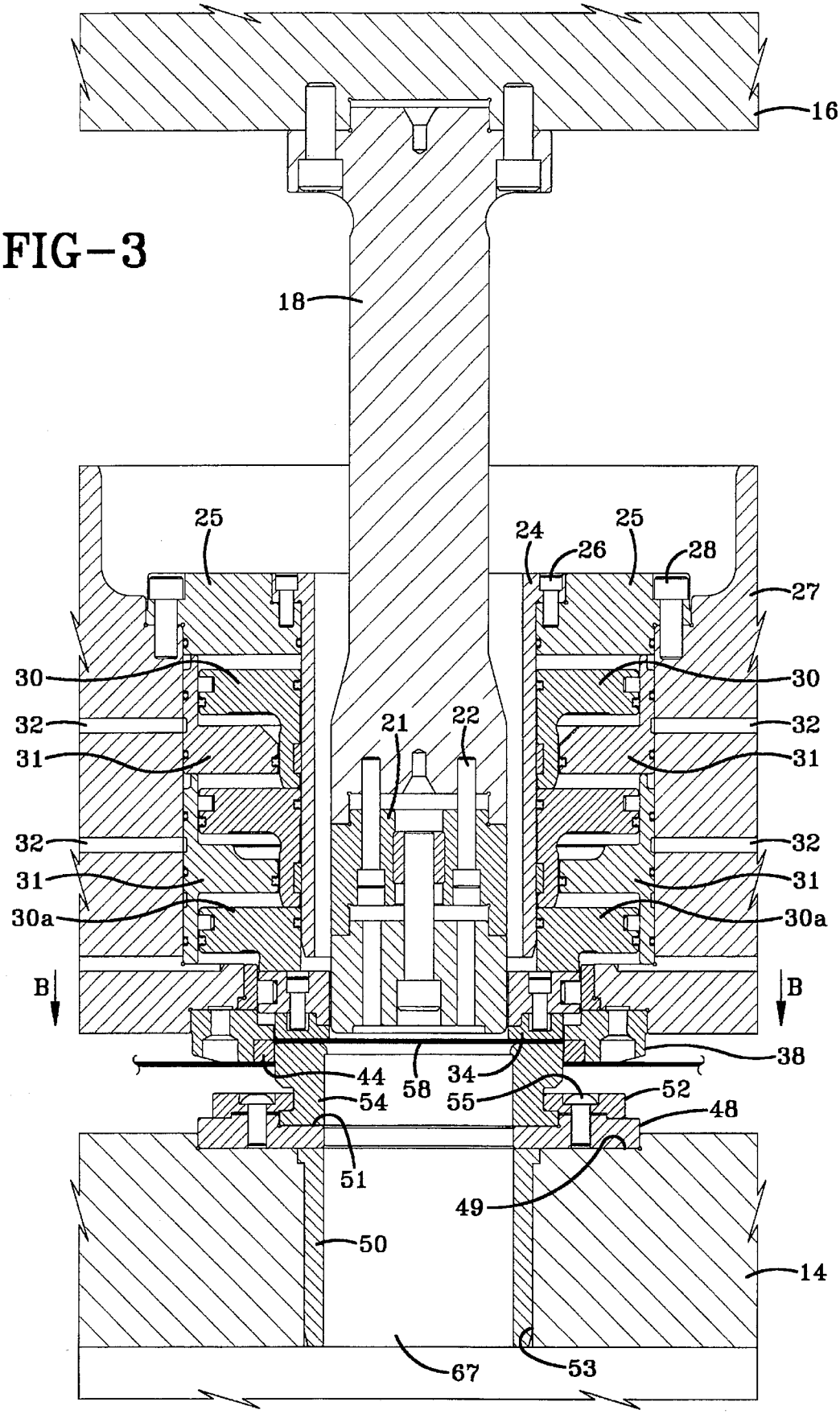
FIG. 3 is a sectional view similar to FIG. 2 showing the position of the one assembly after the blanking of a first blank disk from the sheet material and clamp pressure applied thereto.
Figure 4:
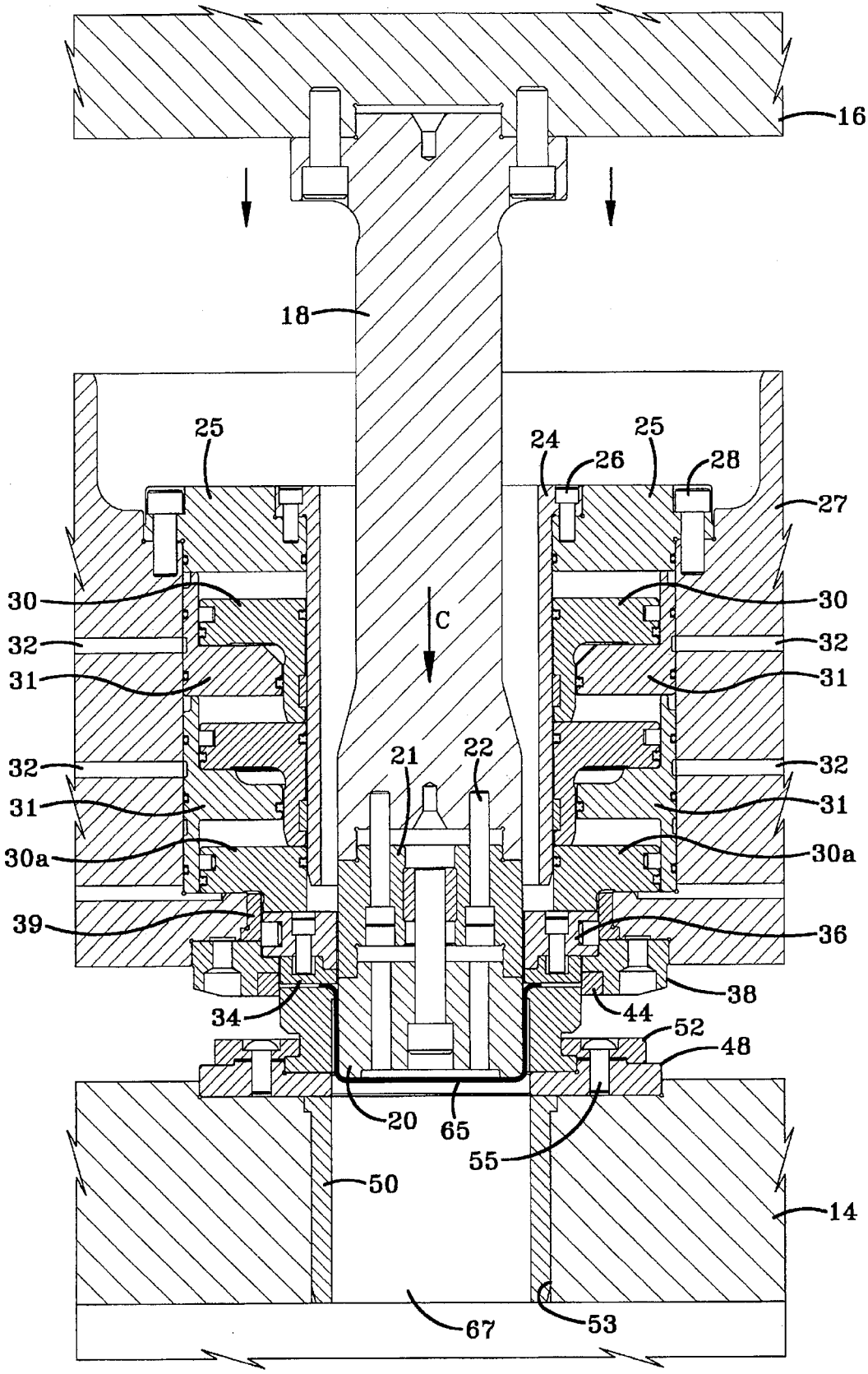
FIG. 4 is a sectional view similar to FIGS. 2 and 3 showing the position of the one assembly during the drawing of one of the container bodies.

FIG. 2 shows the position of the various components of one of the assemblies with respect to base 14 at the start of a cycle for forming a container body from a continuous strip or sheet 57 of material, such as steel or aluminum. FIG. 3 shows the position of the various components of this assembly after the outer ram has moved downwardly toward base 14, as shown by arrows B, and cut edge 44 has moved along the outer periphery of blank and draw die 54 to form a disk-shaped blank 58. FIG. 4 shows the position of draw horn 20 and its engagement with blank 58 just prior to the final drawing of a cup-shaped container body from the disk, in which position the upper ram has started its upward descent so as to release the holding pressure of draw pad 34 with respect to blank and draw die 54, permitting the peripheral edge 60 of blank 58 to move from between draw pad 34 and blank and draw die 54, as draw horn 20 continues to move downwardly in the direction of arrow C. Again, the various operations and positions of the components movable by the inner and outer die ram, shown particularly in FIGS. 2–4, are well known in the art.

One of the main features of the invention is best illustrated in FIGS. 6–9. Each of these figures shows three of the nearly identical assemblies, as shown in FIGS. 2, 3 and 4, with the only difference therebetween being described further below. In accordance with the main feature of the invention, the height of top flat surface 60 of blank and draw die 54 above top surface 61 of base 14 will vary slightly in each of the individual assemblies, which are indicated by letters A, B and C. This height is indicated by arrows $H_1$, $H_2$ and $H_3$.

Figure 6:
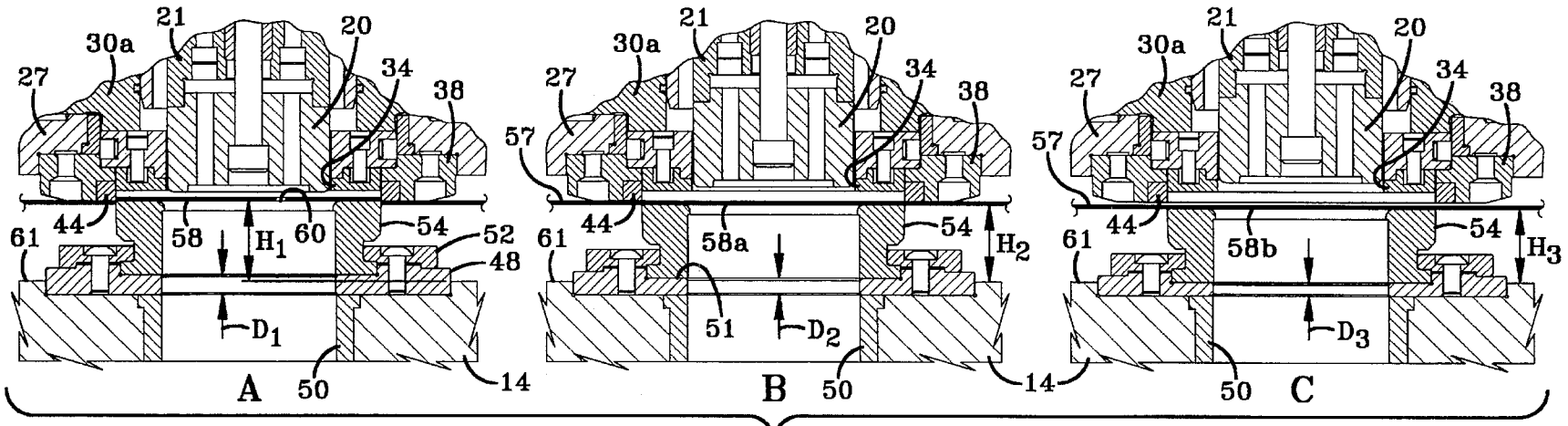
FIG. 6 is a fragmentary elevation sectional view of three of the assemblies of the apparatus showing the sequential blanking of the disks from the sheet material.

As shown in FIG. 6, as cut edges 44, which lies in a common horizontal plane, are moved vertically downwardly by outer ram 12, they will sequentially engage material strip 57. The difference in elevation of top surface 60 of blank and draw die 54 is chosen so that after cut edge 44 of assembly A has just cut through strip 57 to form disk-shaped blank 58, cut edge 44 of assembly B preferably will just be initiating contact with strip 57, and cut edge 44 of assembly C preferably will be slightly spaced above strip 57 a distance generally equal to the thickness of strip 57. Thus, as the outer ram moves downwardly, cut edge 44 will form disk 58 in assembly A, cut edge 44 of assembly B will immediately form blank disk 58*a*, followed immediately by the formation of blank disk 58*b* by cut edge 44 of assembly C.

Thus, the difference in elevation of top surface 60 between each of the succeeding assemblies will preferably be equal to the thickness of material strip 57 so that, as the outer ram moves downwardly, the leading cut edge has substantially through the strip of material before the succeeding cut edge starts its cut, which is then followed by the next cut edge after the preceding cut edge has cut through the material strip. This sequential blanking of the individual disks or blanks from material strip 57, even though it occurs in fractions of a second, will materially reduce the forces exerted on the press and components thereof than that which occurs in prior art presses where a plurality of blanks are simultaneously blanked from the sheet material at the same instant of time.

Figure 7:
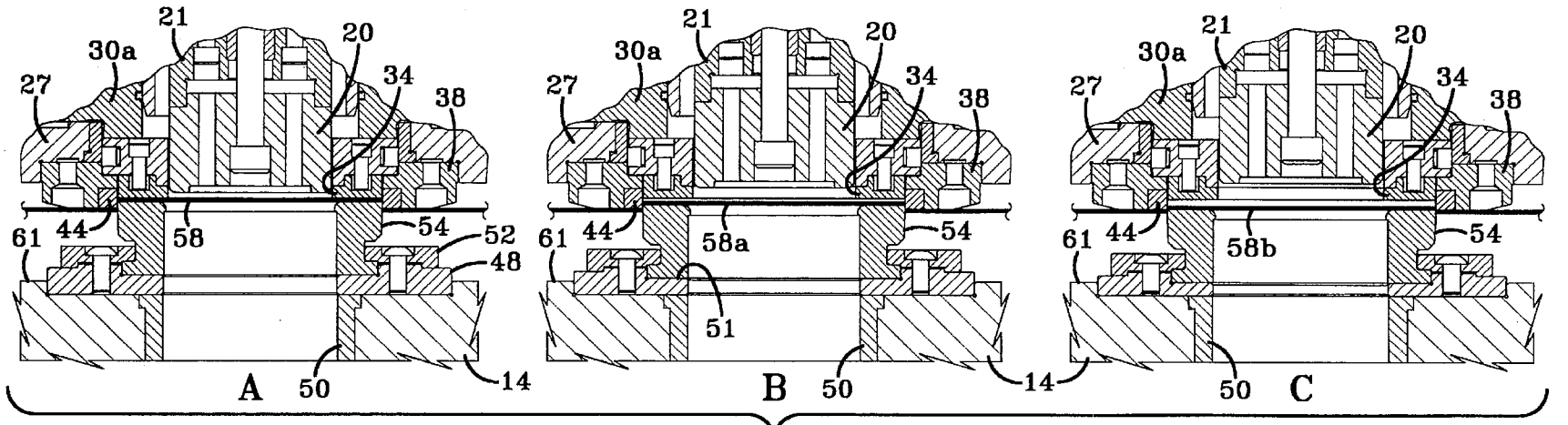
FIG. 7 is a fragmentary sectional view similar to FIG. 6 showing the sequential holding of the peripheral edges of the blank disks as the outer ram continues to move toward the lower blank and draw dies.

FIG. 7 shows the next step in the forming of the can bodies in accordance with the invention. The individual draw pads 34, which are being moved by the outer ram, will also sequentially engage the annular peripheries of the just-formed blank disks, clamping the peripheries against top surface 60 of blank and draw die 54. Draw pads 34 also lies in a common horizontal plane as they are being moved simultaneously vertically downwardly by the outer ram. Again, due to the difference in elevational height of blank and draw die top surfaces 60, it will result in the individual draw pads sequentially clamping the blank peripheries against blank and draw die top surfaces 60. As shown in FIG. 7, draw pad 34 of assembly A has just made contact with the periphery of disk 58, whereas draw pads 34 of assemblies B and C are still vertically spaced therefrom. The continued movement of outer ram 10 will then cause draw pad 34 of assembly B to clamp the periphery of disk 58*a*, immediately followed by the clamping engagement of draw pad 34 of assembly C against the periphery of disk 58*b*.

Again, this sequential application of the clamping pressure between draw pads 34 and top surfaces 60 of the blank and draw dies will reduce the forces and vibrations exerted on the press, than those that occur with prior art presses where all of the draw pads simultaneously clamp the blank peripheries against the blank and draw die top surfaces.

Another important feature of the invention is shown in FIG. 6. The vertical separation is maintained between cut edges 44 and draw pads 42 as outer ram 12 moves downwardly to ensure that the cut edges will cut completely through strip material 57 before draw pads 42 clamp the peripheral blank edges against the respective blank and draw die. Again, this staggers the forces exerted on the press by ensuring that the cutting force occurs before the holding pressure is applied in each individual assembly, thereby reducing the forces that occur in prior art presses where the cut edges engage the strip material simultaneously with the holding engagement of the draw pad with the blank.

Figure 11:
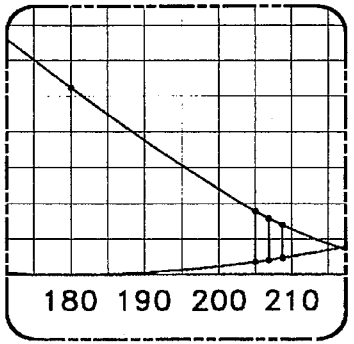
FIG. 11 is an enlarged view of the portion shown in dot-dash lines in FIG. 10.
Figure 10:
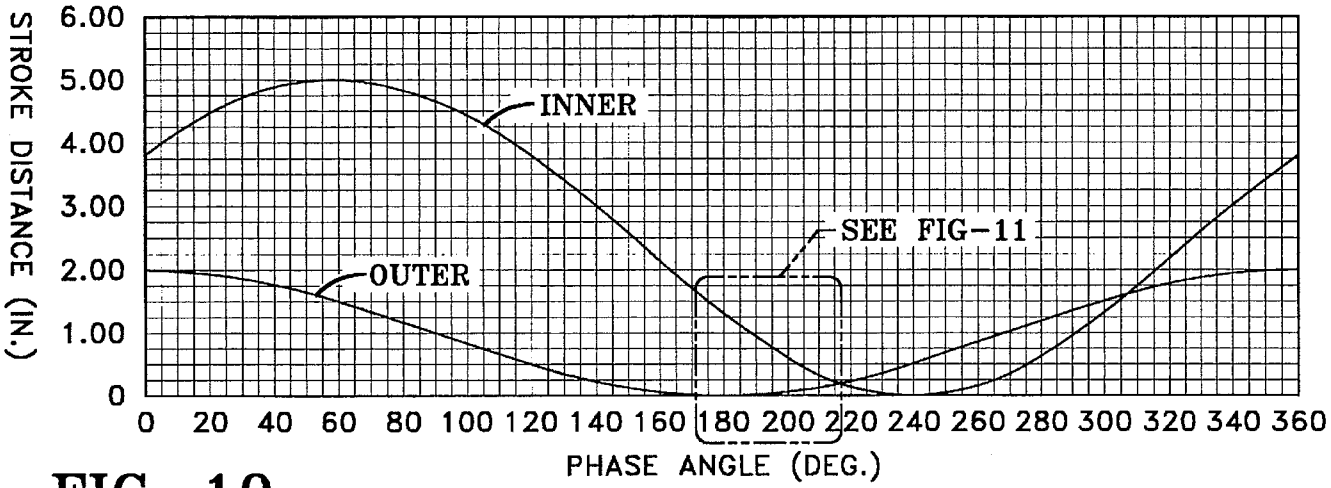
FIG. 10 is a timing diagram of the inner and outer rams of the press.
Figure 8:
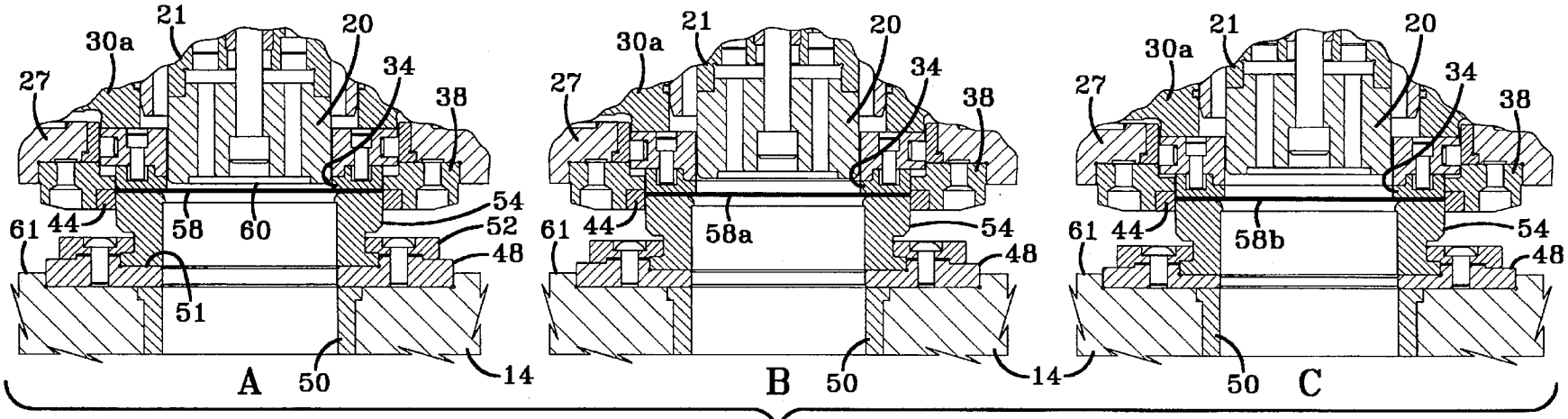
FIG. 8 is a sectional view similar to FIGS. 6 and 7 showing the position of the assemblies after the peripheries of the disks have been clamped and the inner ram moves toward the held disks.

FIG. 8 shows the position of the various components of assemblies A, B and C after the blank disks have been formed and are secured in a clamped position by draw pads 34 on the top surface of blank and draw dies 54, and with draw horns 20 moving vertically downwardly toward the held disks. The bottom working surfaces 63 of draw horns 20 lie in a plurality of staggered horizontal planes, which are parallel with top surface 61 of base 14, with horn 20 of assembly A being shown below that of horns 20 of assemblies B and C, etc. This ensures that pressure pads 34 start to relieve pressure on the clamped disk peripheries as they reach the positions as shown in FIG. 4 to prevent pinching of the material. Again, due to the staggered elevation of the top surfaces of blank and draw dies 54, and, correspondingly, the differences in elevation of the clamped disks, in coordination with the staggered arrangement of horns 20 and the timing cycles of the inner and outer rams as shown in FIGS. 10 and 11, draw horn 20 of assembly A will engage disk 58 before surface 63 of draw horn 20 of assembly B engages disk 58*a* and, correspondingly, surface 63 of draw horn 20 of assembly C engaging disk 58*b*. Again, the staggered engagement of the draw horns with the blank disks further reduces the forces exerted on the press than occurs in prior press constructions where all of the draw horns simultaneously engage the clamped disks.

Figure 9:
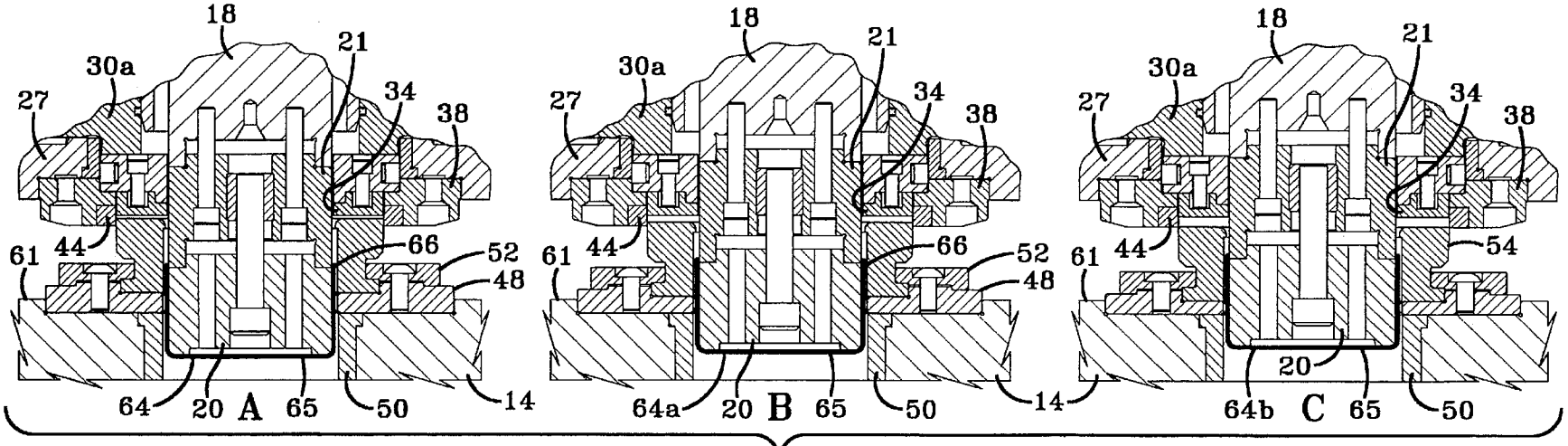
FIG. 9 is a sectional view similar to FIGS. 6–8 showing the sequential drawing of three container bodies from the blank disks of FIG. 8.

FIG. 9 shows the position of draw horns 20 after the disk-shaped blanks have been drawn into cup-shaped container bodies indicated at 64, 64*a* and 64*b*. Each of the container bodies has an annular bottom wall 65 and a cylindrical side wall 66. The container bodies will be identical even though the vertical height of the individual blank and draw dies are different, since the draw horns 20 will continue to move downwardly through cup drop sleeve 50 until the formed container body drops out of a bottom open end 67 of drop sleeve 50 into a collection receptacle, conveyor belt or the like.

One manner in which the difference in vertical heights of top surfaces 60 of blank and draw dies 54 can be achieved is by varying the thickness of retainer rings 48. These distances are shown particularly in FIG. 6, and designed as $D_1$, $D_2$ and $D_3$, and provide for the differences in distances $H_1$, $H_2$ and $H_3$, without having to modify any of the other components of assemblies A, B and C. Thus, blank and draw dies 54 and die clamps 52 will all be identical, requiring only changing the thickness of rings 48. As indicated above, this difference in thickness preferably will be equal to the thickness of the material strip for each successive assembly used in a particular press.

Thus, in order to adapt an existing press and assemblies thereof for carrying out the steps of the present invention, it requires only that the individual blank and draw die retainer rings 48 being slightly modified. However, it is also easily seen that other changes could be made to affect these differences in elevation, such as changing the height of the individual blank and draw dies 54, the height of the base area surrounding the blank and draw dies, etc. However, the slight modifications to the blank and draw die rings 48 has been found to be effective in adjusting for these differences in elevation.

Figure 5:
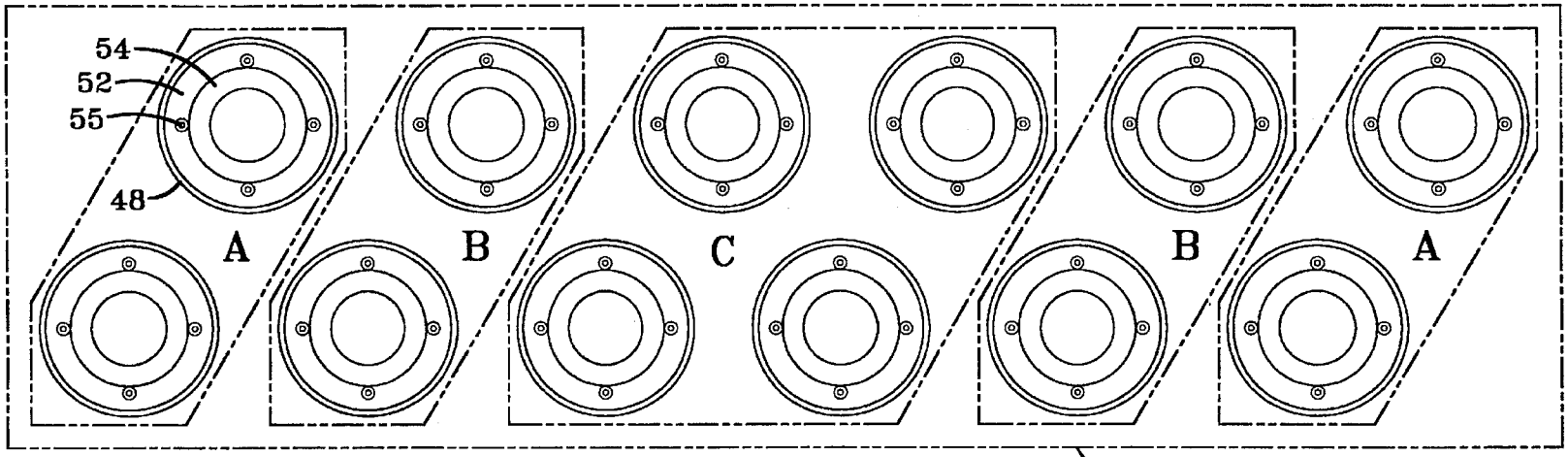
FIG. 5 is a top view of the base and a plurality of the lower blank and draw dies for the forming of twelve container bodies in a single press stroke.

Another feature of the invention is shown in FIG. 5, in which twelve blank and draw dies 48 are mounted on base 14 in an alternating staggered relationship in a twelve-out die, wherein twelve container bodies are formed with each stroke of the press. In order to better distribute the forces in a balanced condition on the press, the two outer pairs of assemblies A will have the same height of top surfaces 60 of blank and draw dies 54 so that four container bodies are formed simultaneously, as described above by assemblies A, followed by the simultaneous formation of four container bodies by the intermediate four assemblies B, then followed by the formation of four additional container bodies being simultaneously formed in the sequential relationship by four separate assemblies C. Again, this sequential forming of a plurality of container bodies in a balanced configuration as shown in FIG. 5, in addition to reducing the amount of forces on the die, will assist in distributing and maintaining the forces balanced throughout the apparatus and press. It is readily understood that other sequences of operation can be used, such as, first forming the four container bodies of assemblies C followed by assemblies A and then C, or vice versa.

FIGS. 10 and 11 show the timing sequence of the movement of the inner and outer rams in order to achieve the above sequential forming of the container bodies, which, again, is similar in many respects to that of usual press constructions, since the main difference is the adjustment of the engagement of the strip material by the cut edges, followed by the pressure engagement of the draw pads, and then engagement of the clamped disks by the draw horns moved by the inner ram.

Accordingly, the improved apparatus and method of the invention provides for the formation of a plurality of container bodies in a single press stroke, by sequentially blanking, clamping and then drawing the strip material in a plurality of individual assemblies, to reduce the overall pressure exerted at any one instant of time on the press and components thereof, as occur in prior art presses and die apparatus, where these steps are all performed simultaneously.

Although the above discussion is directed toward the forming of cup-shaped container bodies, it is readily understood that the same procedure can be used for forming the end shells of the containers, which are subsequently attached to the container bodies, without affecting the concept of the invention.

Accordingly, the method and apparatus of the present invention for sequentially forming can bodies or end shells is simplified, provides an effective, safe, inexpensive, and efficient method and apparatus which achieves all the enumerated objectives, provides for eliminating difficulties encountered with prior devices and methods, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved method and apparatus for sequentially forming can bodies is constructed and used, the characteristics of the apparatus and method, and the advantageous, new and useful results obtained; the new and useful structures, devices, elements, arrangements, parts and combinations, and method steps are set forth in the appended claims.

We claim:

1. A method of forming a plurality of cup-shaped members from a metal sheet in a single continuous stroke of a double-acting press having inner and outer rams, including the steps of:

feeding the metal sheet between a plurality of lower blank and draw dies and a plurality of vertically aligned upper draw horns, draw pads and cut edges;

simultaneously advancing a plurality of cut edges and draw pads toward the metal sheet and the blank and draw dies by movement of the outer ram;

sequentially blanking a a plurality of disks from the metal sheet by advancing the cut edges in a continuous stroke of the outer ram beyond the blank and draw dies;

sequentially clamping peripheries of the disks against the blank and draw dies only after completion of the blanking of all disks from the metal sheets upon further advancement of the draw pads by the continuous stroke of the outer ram;

simultaneously advancing the draw horns toward the disks by movement of the inner ram; and drawing a plurality of cup-shaped members from the disks, by the advancement of the draw horns in a continuous single stroke of the inner ram.

2. The method as defined in claim 1, including advancing the cut edges in the direction of the base after clamping the disks against the blank and draw dies.

3. The method as defined in claim 1 including the step of arranging top surfaces of blank and draw dies at different elevations above the base to provide for the sequential cutting and clamping of the disks.

4. The method as defined in claim 1 including the step of sequentially cutting two disks from-first sections of the metal sheet and then sequentially cutting at least two other disks from second sections of the metal sheet after the sequential cutting of the two disks from the first sections of said sheet.

* * * * *